United States Patent [19]

Parren

[11] Patent Number: 5,035,608

[45] Date of Patent: Jul. 30, 1991

[54] SAFETY LOCKING DEVICE

[76] Inventor: Joseph R. Parren, 19638 N. 34th Dr., Phoenix, Ariz. 85027

[21] Appl. No.: 597,482

[22] Filed: Oct. 10, 1990

[51] Int. Cl.[5] ..... F23D 11/36

[52] U.S. Cl. ..... 431/153; 431/277; 206/1.5; 206/86; 206/528

[58] Field of Search ..... 431/153, 276, 277; 222/183; 206/1.5

[56] References Cited

U.S. PATENT DOCUMENTS 4,799,877 1/1989 Bisbee ..... 431/153

4,830,603 5/1989 Cirami ..... 431/153

*Primary Examiner*—Carroll B. Dority

*Attorney, Agent, or Firm*—Gregory J. Nelson

[57] ABSTRACT

A device to render articles such as disposable lighters resistant to unauthorized use including a body which slidably receives the lighter. In the normal protected position, the lighter is within the housing and is restricted from extension from the body to a use-position by a locking pin carried on a rocker arm. The rocker arm controls the position of the locking pin and may not be released unless the lighter is inverted releasing a tumbler freeing the rocker arm and thus permitting depression of the rocker arm to disengage the locking pin from the lighter. In the disengaged position, the user may slide the lighter relative to the sleeve to a use-position in which the lighter may be actuated. The safety device may be applied to other articles to make them child-resistant such as medicine containers.

19 Claims, 5 Drawing Sheets

SAFETY LOCKING DEVICE

The present invention relates to a safety device and more particularly to a safety device for use with a protected article or item such as a disposable cigarette lighter or container for medication to render such article child resistant.

The present invention relates to a safety locking device which may be applied to any number of apparatus. The security of the device derives from a construction which requires that the device must be placed in a position to unlock the device or defeat the device which position is inconsistent with the use of the primary article. The manipulation necessary to unlock the device makes the device difficult for small children to intentionally or inadvertently perform. While the safety device of the invention has multiple applications, it is particularly useful in addressing the hazard of gas-fueled lighters in the hands of children. Other applications include containers such as those for medications.

The Consumer Product Safety Commission is concerned with the problem of the hazards of butane or gas lighters in the hands of children. These lighters are generally disposable having a body housing a fuel reservoir and release of the fuel is controlled by a gas release lever. The fuel is generally ignited either by a pyrophoric or piezoelectric ignition means. The Consumer Product Safety Commissioner conducted a study that indicates that as many as 120 deaths occur each year due to children playing with lighters of this type. As a result, there exists a need for a device to make flame-producing consumer products more difficult for children to operate. The easy accessibility of flame-producing devices such as disposable lighters presents a widespread hazard. It is impossible to effectively limit the accessibility to children but a feasible approach is to equip the lighters with a device which will render such lighters child-resistant to minimize the potential for accidents.

A number of safety devices can be found in the prior art which have application to disposable lighters. For example, U.S. Pat. No. 2,588,479 shows a lighter-locking mechanism which utilizes a sleeve and balls to lock the lighter against actuation when the lighter is in a position other than the normal operating position.

U.S. Pat. No. 4,832,596 shows a child-resistant cigarette lighter having a stop member slidably mounted on the lighter that is engageable with the gas valve actuation lever.

U.S. Pat. No. 4,822,276 discloses a mechanically-biased clutch capable of preventing rotation of the friction wheel when the clutch is engaged. The clutch is designed to make the lighter safer especially to guard against use by children.

U.S. Pat. No. 4,799,877 discloses a safety device for cigarette lighters and shows a barrier which is adapted to selectively engage the thumb lever of the lighter to restrict the motion of the thumb lever to prevent release of gas to the burner tip. A restricting member is supported by a band or sleeve that surrounds or is slidably engageable about the body of the lighter. The sliding motion of the band may be selectively prevented or permitted by engaging or disengaging a spring-loaded member which has a projection which engages an opening in the lighter structure.

U.S. Pat. No. 4,784,601 shows a gas lighter equipped with a safety lock in the form of an L-shaped stop which is selectively engageable with the gas actuation lever.

U.S. Pat. No. 4,758,152 shows a safety mechanism having a bar which is pivotally connected to a sleeve about the top portion of the lighter. The bar may be locked into position to prevent depression of the gas actuation lever.

U.S. Pat. No. 4,859,172 shows a safety lock rotatively mounted on the top of a lighter casing to prevent actuation of the thumb-operated push cap.

From the foregoing, it will be seen there are a number of patents showing lighter safety devices which prevent operation of the lighter actuator. However, for one reason or another these devices have not generally gained wide acceptance and often do not meet acceptance criteria for determining the effectiveness of such devices.

Accordingly, it is an object of the present invention to provide a device which may be fabricated as part of the lighter housing or may be in the form of a lighter case which incorporates a feature making it more difficult for children to operate the lighter and still allow adults to successfully activate the lighter in a normal, safe and convenient manner. The lighter safety device of the present invention also is designed to conform to the following criteria:

1. The device is passive and re-sets itself in normal operation;

2. The device does not impair safe operation of the lighter when used in a normal, convenient manner; and 3. The safety features may not be easily override or deactivated by a child.

One of the functional advantages of the present invention is that the device must be placed in an orientation or position inconsistent with its operation in order to deactivate or unlock the device. As such, the device may not be easily overriden or deactivated or circumvented, particularly by a child.

Accordingly, it is a primary object of the present invention to provide a child-resistant safety device having the various features and advantages set forth above.

The present invention is described in conjunction with a disposable lighter, but it will be apparent that the safety device may be applied to any number of items or articles in which the engagement of a rod, pin or bolt will deactivate or prevent the actuation of the primary device. In addition to use with lighters, the invention has particular application to containers which contain drugs and medications.

Briefly, the present invention relates to a locking device which may be incorporated in a sleeve which fits about the lighter or other protected article. The locking device has a pin which, when the lighter is contained within the sleeve, engages a part of the lighter to prevent use of the lighter. For example, in a locked condition, the pin will block the gas actuation lever of the disposable lighter to prevent it from being depressed. The pin is carried on a rocker arm which, in the locked position, extends inwardly of an interior wall of the sleeve to block the gas control lever. A channel extends in the area of the sleeve adjacent the rocker arm containing a locking member which in the normal upright position prevents depression of the rocker arm and maintains the locking pin in the engaged position. When the device is inverted, the locking member moves within the channel to a position permitting depression of the rocker arm and disengagement of the locking pin from the gas control lever. In this position, the lighter housing may be moved relative to the sleeve to extend the gas control lever and igniting device to a position where it may be actuated by the user. After use, the lighter may be manually returned to its housed position in the sleeve, returning the locking pin to an engaging position with the lighter in which position the device is child resistant. In the case of a medication container, the safety device receives the container and the locking pin prevents the container from being extended to a position in which access to the container is permitted.

The above and other objects and advantages of the present invention will become more apparent from the following description, claims and drawings in which:

Figure 1:
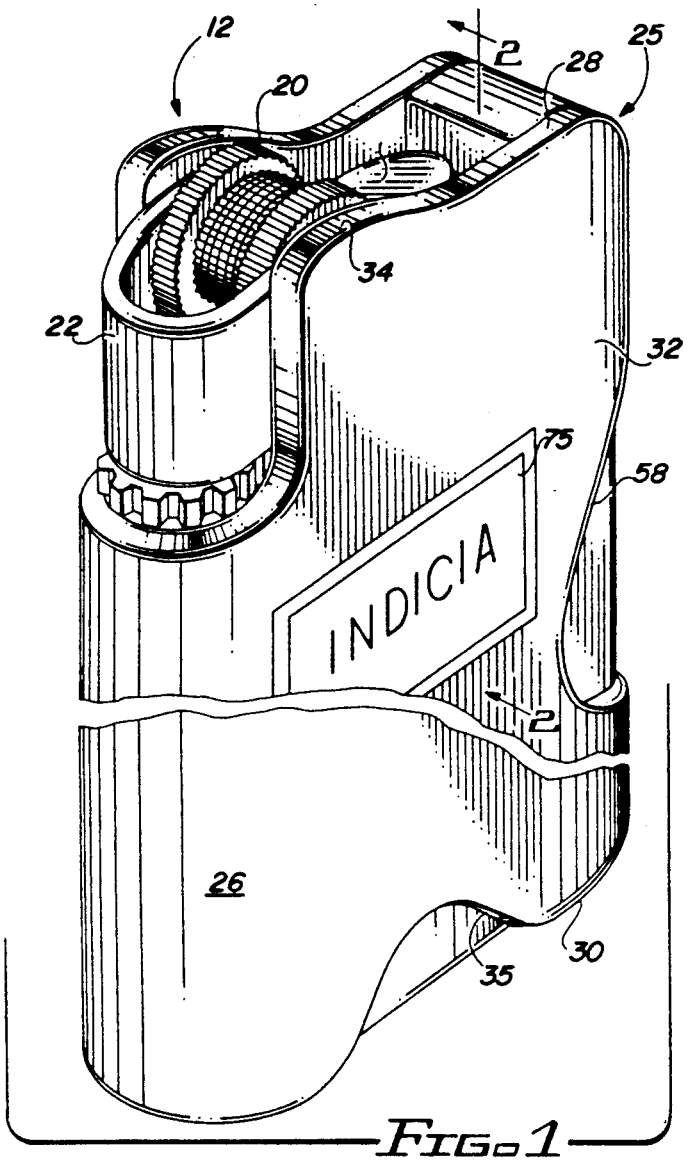
FIG. 1 is a perspective view of a lighter and associated safety device.

Turning now to the drawings, particularly FIGS. 1 to 7, an embodiment of the safety locking device of the present invention is generally designated by the numeral 10 and is shown in connection with a protected article which is a disposable lighter 12. The disposable lighter 12 is of conventional construction having housing 14 which contains a gas reservoir 16. A gas control lever 18 operates a valve to selectively release gas from the reservoir for ignition when depressed. A suitable ignition device 20 which may be a pyrophoric device or may be a piezoelectric device is secured to the top of the housing and is manually operated by the user to ignite gas when the gas control lever is depressed. As shown, the ignition device is a flint wheel 20 operates to create a spark adjacent the gas release orifice or nozzle. A windshield 22 may be fixed to the housing to surround or partially surround the gas ejection nozzle. A recess 24 is defined below the gas control lever 18 and the upper end of the housing to provide a clearance space so that the gas control lever may be pushed downwardly to release fuel. The lighter is generally operated by grasping the housing with the fingers and operating the ignition device and the gas control lever with the thumb in a continuous motion striking the ignition device 20 and thereafter depressing the gas control lever 18. The gas control lever is held in a depressed position for as long as the flame is desired. Release of the gas control lever will extinguish the flame. There are a number of commercially available lighters of this general type in the market such as those sold under the trademarks SCRIPTO and BIC.

The terms "upper" and "lower" are used throughout to refer to an orientation of the lighter and housing in the normal, upright position of use in FIG. 1.

The safety device of the present invention is generally designated by the numeral 25 and may be provided as part of the lighter as supplied by the lighter manufacturer or may be provided as a separate accessory item adapted to receive the lighter. To this end, the safety device has a sleeve 26 which is generally elongate having a top 28, bottom 30, and an exterior side wall 32. The top wall has a contoured configuration forming a shield 34 which with the lighter fully inserted extends adjacent the igniter and gas lever at opposite sides. The bottom edge defines a recess 35 which exposes a portion of the lighter so the lighter may be easily manually extended.

Figure 3:
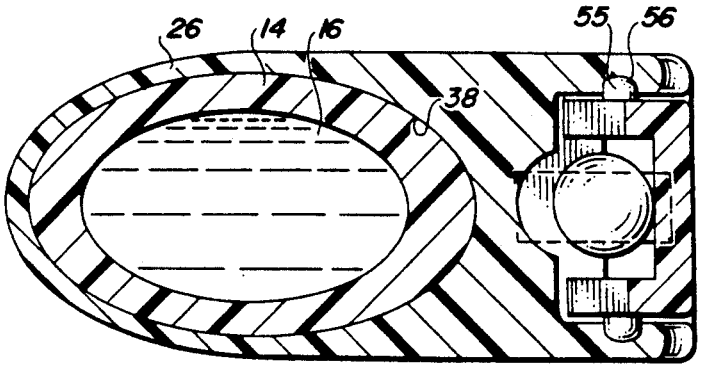
FIG. 3 is a sectional view taken along lines 3—3 of FIG. 2.

Sleeve 26 defines a longitudinally extending opening 38 having a cross sectional shape conforming to the exterior shape of the housing 14 of the lighter which is received therein. The lighter may be removed from the sleeve and replaced when the fuel is exhausted. The sleeve of the safety device may extend entirely or partially around the lighter but will engage the lighter in a manner so that the lighter is axially or longitudinally slidable relative to the sleeve 26 of the safety device. Preferably for compactness, the sleeve of the safety device is enlarged only in the area immediately adjacent the gas control lever 18 to house the operational components of the safety device. As best seen in FIG. 3, the remaining portions of the side wall of the housing can be of reduced thickness for compactness and for aesthetic considerations.

Figure 2:
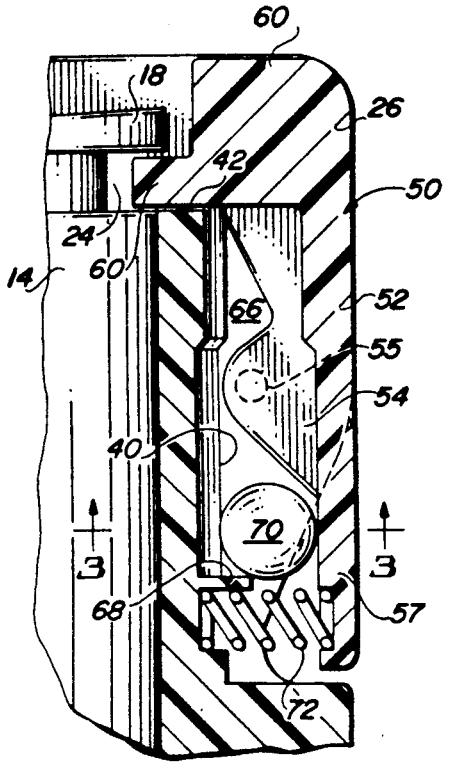
FIG. 2 is a sectional view taken along lines 2—2 of FIG. 1 showing the safety device in a locked position.

As shown in FIG. 2, sleeve 26 defines a channel 40 extending parallel to the lighter. The channel is at least partially open along the outer side wall of the sleeve. The upper edge 42 of the channel aligns with recess 24 of the lighter when the lighter is in the housed position shown in FIG. 2. In the housed, locked condition in which the lighter is rendered inoperable, the lighter assumes the position shown with the recess 24 below the gas control lever aligned with the upper edge 42 of channel 40.

A rocker assembly 50 is pivotally mounted within the channel 40. The rocker assembly 50 has a longitudinally extending body 52 which is pivotally supported at midpoint by fulcrum 54 extending and engaging the interior of the channel at pivot pins 55 engaging recesses 56 in the opposite channel walls. A portion of the rocker arm defines a longitudinally extending, manually actuable thumb lever 57 which is accessible through the slotted opening 58 in the sleeve of the safety device. The upper end of the rocker arm carries a head 60 having a locking pin 62 which, in the locked position, extends into the recess 24 below the gas control thumb lever. It will be observed, as best seen in FIG. 2, that in this position depression of lever 18 of the lighter is presented or blocked by the position of the locking pin. The pin may also engage other areas of the contained lighter to render it inoperable. For example, the pin may extend over the top of the gas control lever 18 to prevent it from being actuated.

A passageway 66 extends along the channel from a location adjacent the head 60 of the rocker assembly to the stop 68 adjacent the lower end of the channel. A tumbler 70 is freely moveable along the channel. The tumber 70 is shown as a spherical ball of metal or plastic which travels along passageway 66 under the influence of gravity. The lower end of the rocker assembly is normally biased to the position shown in FIG. 2 by biasing member 72 which is shown in the form of a spring interposed between the rocker assembly and the housing.

Figure 4:
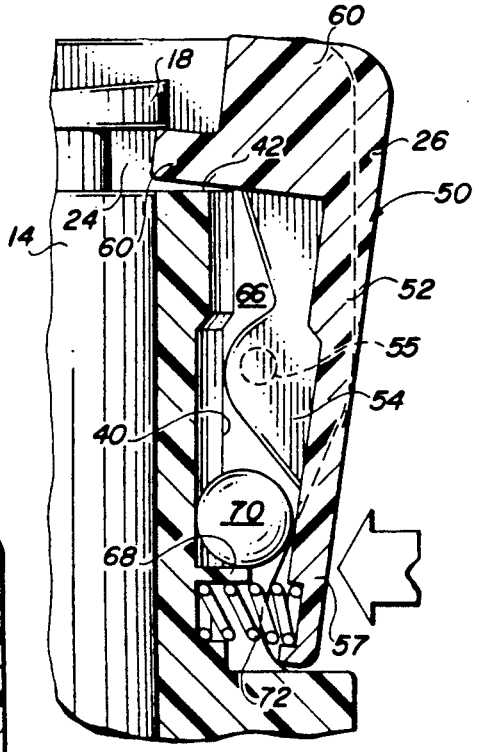
FIG. 4 is a view similar to FIG. 2 showing the safety device in a locked position with the locking member obstructing movement of the rocker arm.

In the normal locked position, tumbler 70 will assume the position shown in FIG. 2 at the lower end of the channel 66. As seen in FIG. 4, operation of the lighter is prevented in this position as tumbler 70 interferes with the inward movement of the thumb lever 57. While some limited movement of the rocker may occur it is not sufficient to move pin 62 out of recess 24.

Locking pin 62 in the locked position obstructs actuation of gas control lever 18 preventing ignition of the lighter. Further, the locking pin will secure the lighter relative to the sleeve to prevent the lighter from being manually moved up or down relative to sleeve 26. Accordingly, with the lighter positioned within the sleeve in the normal upright position as shown in FIG. 1, the safety device effectively impedes the use of the lighter serving as a deterrent to use by children or those unfamiliar with the operation of the safety device.

Figure 5:
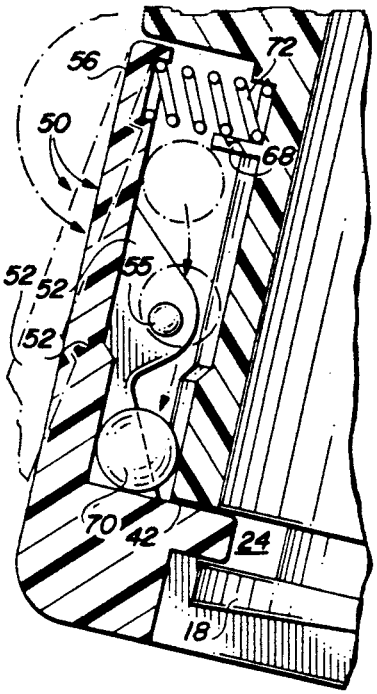
FIG. 5 is a partial sectional view showing the safety device and lighter inverted to a position to permit the safety device to be unlocked.

In the event the user wishes to use the lighter housed within the safety device of the present invention, the user must invert the device and contained lighter. As mentioned above, the manipulation of the lighter to an inverted position is a motion inconsistent with the normal operation of the lighter thus making it an effective impediment to the operation of the lighter by a child or one not familiar with the safety device. When the sleeve and lighter are inverted, tumbler 70 will move along passageway 66 past the pivot points of the rocker assembly to a location at the top of the channel (now inverted) as shown in FIG. 5. In this position, depression of the thumb lever of the rocker is no longer obstructed. Thus, the user may depress the rocker arm causing the rocker arm to pivot about pivot pins 55 rotating the locking pin to a position out of engagement with the lighter gas control lever.

Figure 7:
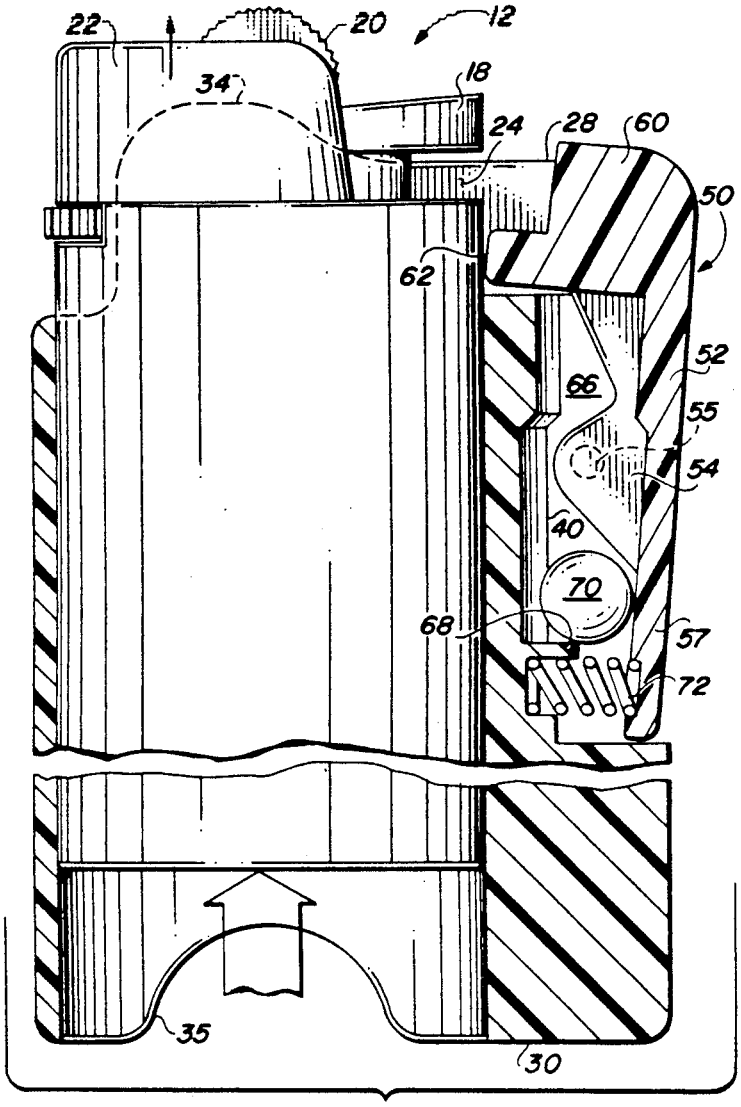
FIG. 7 is a side view showing the lighter extended to a position of use relative to the safety device.
Figure 6:
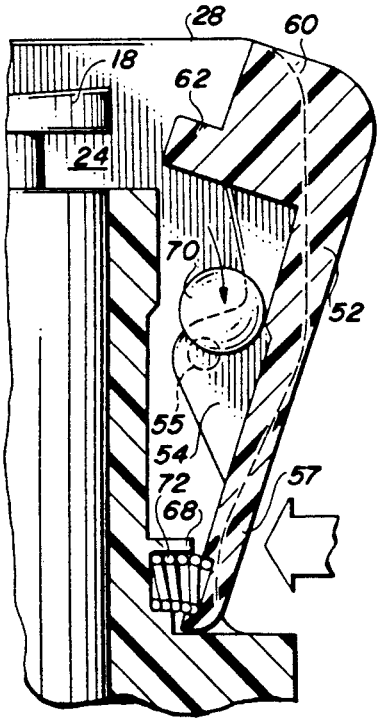
FIG. 6 shows the device in an upright, unlocked position.

The lighter and the safety device may now be uprighted to the position shown in FIG. 6 while force is maintained on the thumb lever as represented by the arrow in FIG. 6. In this position, the locking pin is withdrawn from the recess 24 below the gas control lever which permits the user to manually slide the lighter upward relative to the sleeve 26 by applying pressure on the lower end of the lighter housing to at least partially extend the upper end of the lighter from the housing as seen in FIG. 7. Recess 35 provides convenient access to the lighter housing. With the lighter extended to a use-position, the gas lever 18 and igniter 20 are in positions in which they may be actuated. Locking pin 62 no longer is in a position to interfere with the downward movement of the gas control lever.

Once the operation of the lighter has been discontinued and the user wishes to return the device to the locked position, the lighter may be manually pushed downwardly into the sleeve. The force of gravity will cause the tumbler 70 to return to its normal position at the lower end of the channel. This action will also return the rocker arm to its locked position with the pin 24 assuming a position beneath the gas control lever.

From the foregoing, it will be readily apparent that various shapes or models of disposable lighters can be rendered child-resistant. The device is easy to use, however due to the manipulation necessary to disengage the locking pin, the device will not be easily circumvented by a child. The device may be provided with suitable decoration or indicia 75. When the disposable lighter has been exhausted, a new lighter may be easily inserted. It is further apparent that the device may be easily and inexpensively manufactured.

Figure 9:
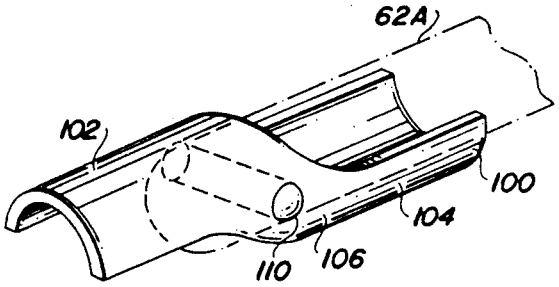
FIG. 9 is a perspective view of the re-set arm.
Figure 10:
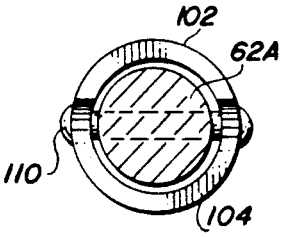
FIG. 10 is a sectional view taken along lines 10—10 of FIG. 8.
Figure 8:
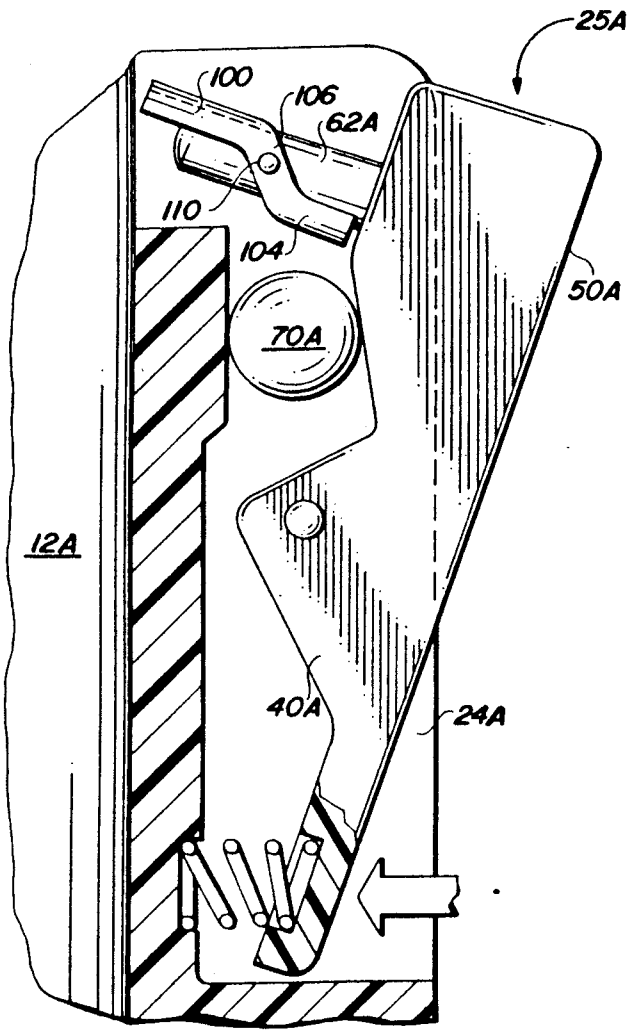
FIG. 8 illustrates an alternate embodiment having means to assist in returning the device to a locked position after use.

FIGS. 8 to 10 show an alternate embodiment of the present invention in which similar elements have been identified with the same numerals as used with reference to FIGS. 1 to 8, with an appended letter "A". The locking device again includes a sleeve 24A having a channel 40A which pivotally receives a rocker assembly 50A having an extending locking pin 62A which in the locked position will move to a position adjacent the lighter gas control lever. A tumbler 70A moves within the channel 40A to impede the operation of the rocker arm except when the device is placed in an inverted position. The advantage of the present embodiment is that it has an additional feature which after each actuation will further assist in automatically resettling the device to a locked position.

To this end, re-set arm 100 is shown as pivotally attached to the locking pin 62A. The re-set arm has an outer, semi-circular sleeve 102 and an oppositely extending semi-circular section 104 which are off-set with respect to one another at side members 106. Side members 106 are pivotally connected to locking pin 62A at pin 110. The outer end of sleeve 102 extends slightly beyond the end of pin 62A. When the pin is in the unlocked position shown in FIG. 8, the outer end of sleeve 102 projects slightly beyond the interior wall of the sleeve. Thus, in operation, when the lighter 12A is to be used, the user will invert the safety device and contained lighter causing the tumbler 70A to drop to the upper end of the channel 40A. In this position, the rocker 50A may be pivoted by depressing the lower end of the rocker causing the locking pin to move to a non-engaged position as shown in FIG. 8. The lighter 12A may now be moved upwardly with respect to the device 25A to place the lighter in a position in which it may be actuated. The upward movement of the lighter will cause the lighter casing to engage the outer end of sleeve 102 causing arm 100 to rotate slightly relative to the locking pin. This rotational movement will impart an opposite, downward rotation to the end of sleeve member 104 imparting a downward force on the tumbler 70A to positively assist the tumbler to return or partially return to the locked position at the opposite, lower end of the channel. When the lighter is manually returned to its protected position seated within the device, the tumbler 70A will return to the bottom of the channel and the locking pin will re-engage the lighter.

Figure 11:
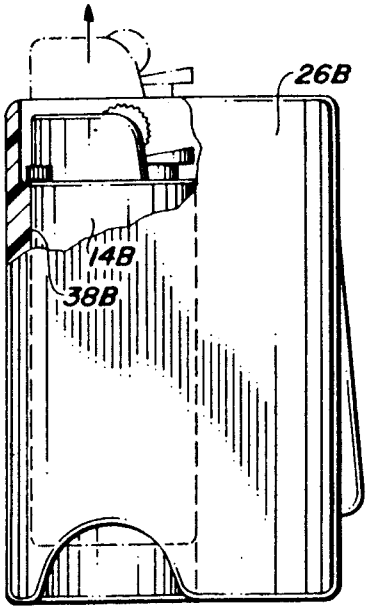
FIG. 11 is a side view, partly broken way, of another embodiment of the invention.
Figure 12:
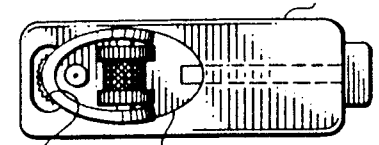
FIG. 12 is a top view of the embodiment of FIG. 11.

FIGS. 9 to 11 show another embodiment of the present invention generally designated by the numeral 200. The principal advantage of embodiment 200 is that once the safety device and protected article has been placed in an inverted position, the tumbler arrangement will secure the rocker and locking pin in an unlocked position until the lighter is manually pushed upwardly relative to the sleeve which will re-set the device. Thus, it is not necessary for the user to continue to apply manual pressure to the rocker as the rocker is uprighted and the contained lighter or article moved to a position of use.

Figure 13A:
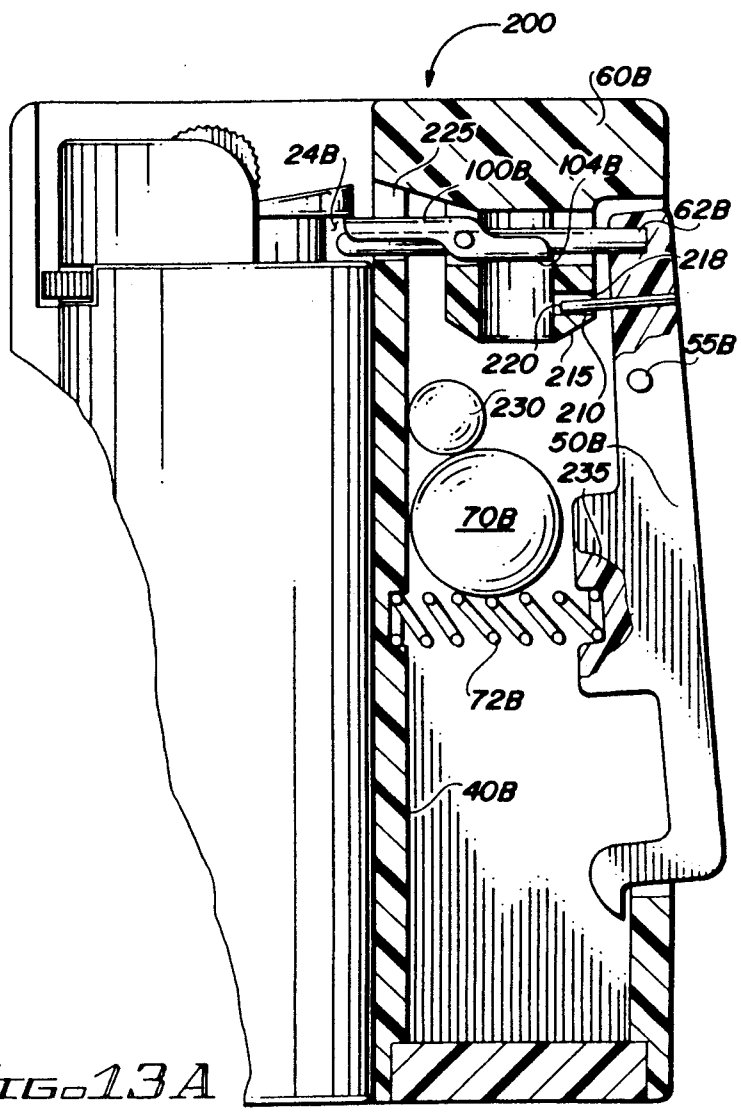
FIGS. 13A to 13E are partial sectional views illustrating the sequence of operation of the embodiment of the safety locking device of FIG. 11.
Figure 13D:
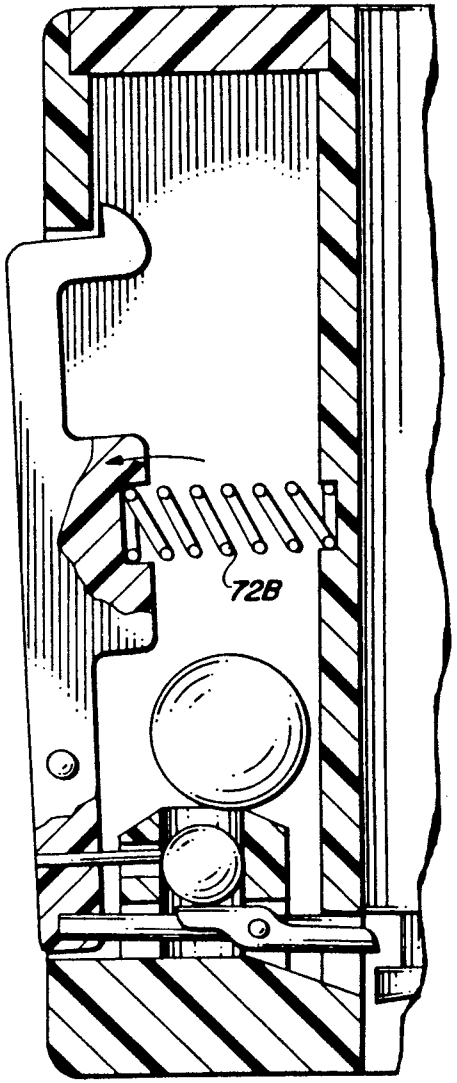
Figure 13C:
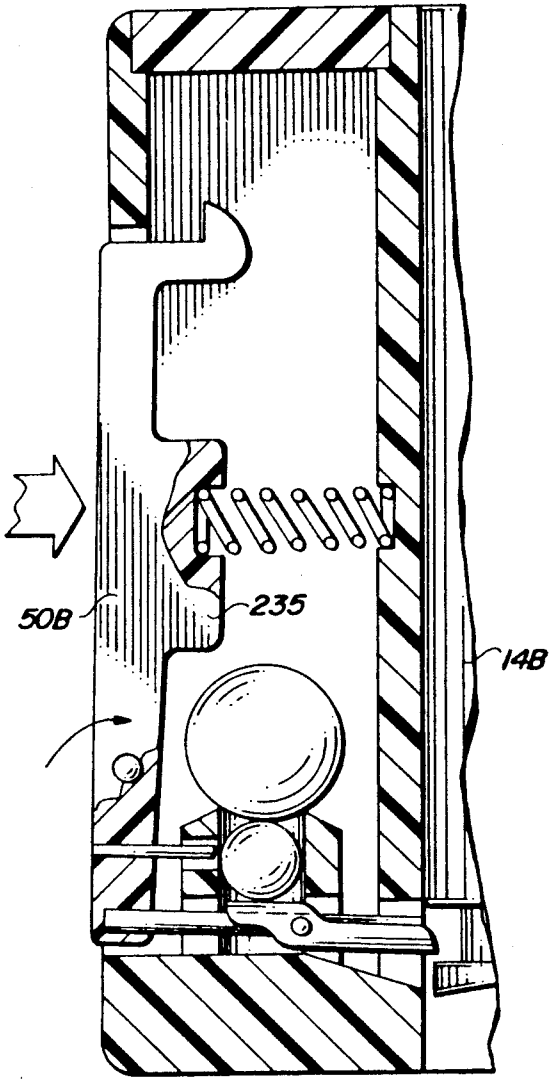
Figure 13B:
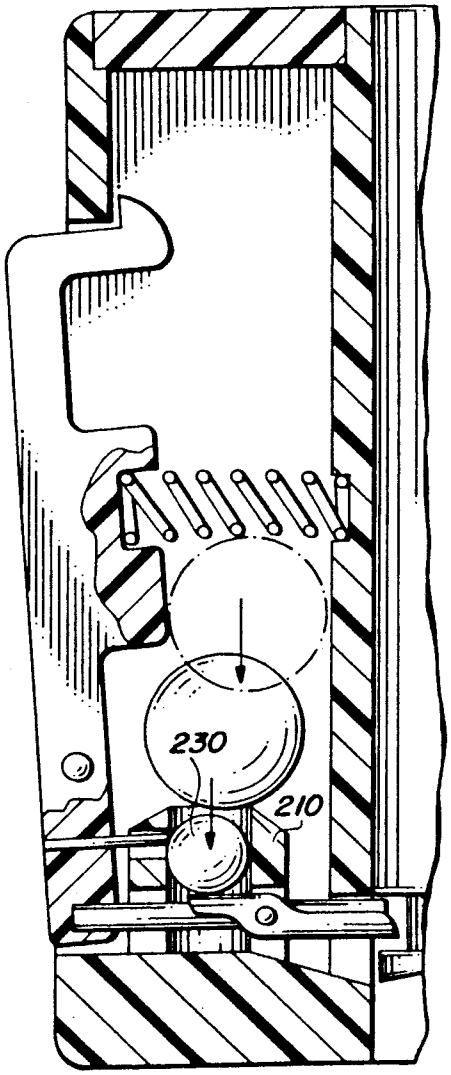

Referring to FIGS. 11, 12 and 13A through 13E, the embodiment of the invention is designated by the numeral 200 and again incorporates a sleeve 26B having a longitudinally extending channel 38B which receives the cigarette lighter 14B permitting the lighter to be manually moved within the sleeve. The lighter, as has been explained before, is provided with a gas control lever and igniter. A channel 40B is formed in the sleeve adjacent the lighter. A longitudinally extending opening in the sleeve receives a rocker 50B which is pivotal about pin 55B at a location above the mid-point of the rocker. The lower end of the rocker is provided with a stop which engages the inside of the channel. A biasing member 72B extends between the inner wall of the channel and a recess with the approximate midpoint of the rocker arm urging the rocker to the position shown in FIG. 13A. A generally tubular or cylindrical tube receptacle 210 is centrally positioned at the upper end of the channel extending from the fixed head 60B at the upper end of the channel. The edges of the tube are tapered outwardly and downwardly at 215 as shown at approximately a 45° angle. A transverse bore 218 extends through the lower end of the tube and receives a locking pin 62B secured at the upper end of the rocker 50B. In the normal locked position, the locking pin 62B extends a sufficient distance to engage a part of the contained lighter. As shown, pin 62B extends into the recess area 24B below the gas control lever to prevent relative movement of the lighter with respect to the case. A re-set arm 100B is pivotally secured to the locking pin 62B having an outer end extending slightly beyond the terminus of the locking pin. Thus, when the device is inverted and rocker is moved to the unlocked position as shown in FIG. 13C, the outer end of the re-set arm 100B extends into the channel. The inner end 104B of the re-set arm 100B is positioned in the end of the tube 210 and is pivotal with respect to the tube.

A detent pin 220 extends inwardly from the rocker arm 50B at a location below the locking pin. The locking pin 62B is reciprocal within a bore 225 in the locking tube at a location adapted to engage a small tumbler 230 when the small tumbler is received with the tube 210.

Figure 13E:
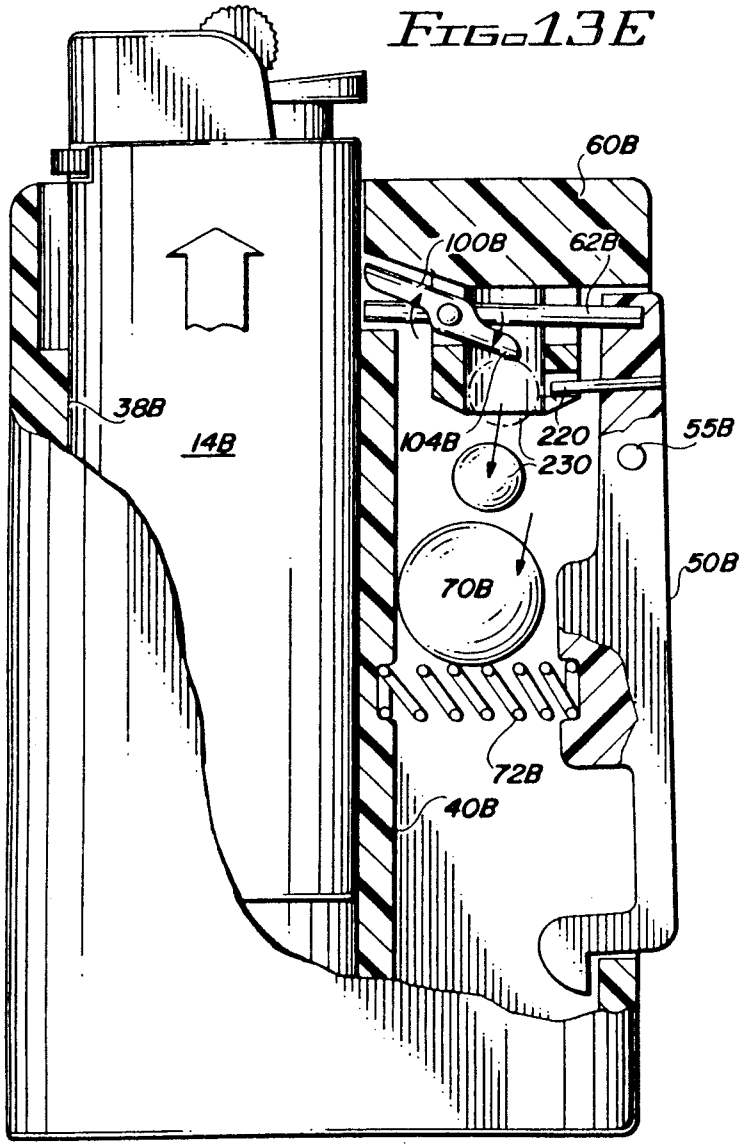

In the position shown in FIG. 13A, force applied at the lower end of the rocker arm 50B will be resisted by the large tumbler 70B which is interposed between the channel wall and the projection 235 on the rocker. Thus, in the normal upright position, the locking pin 62B remains engaged in recess 24B preventing relative displacement of the lighter with respect to the sleeve. When the safety device is inverted to the position shown in FIG. 13B, the small cylindrical tumbler 230 will move under the influence of gravity falling into the tube 210. This allows the large tumbler 70B to also move downwardly clear of the projection 235 on the rocker. In this position, force may be applied to the lower end of the rocker pivoting the locking pin 62B out of the locked position. This allows the small detent tumbler 230 to fully drop into the detent tube 210. Release of force at the lower end of the rocker 50B will allow the rocker to return only to the position in which the inner end of the detent pin 220 engages the surface of the spherical tumbler 230. This is shown in FIG. 13C and it will be noted that the device is now held in an unlocked position. Thus, the user is not required to continually apply force to the rocker while righting the safety device and lighter to an upright position. In this position, although the pin 62B is withdrawn from the recess 24B, the outer end of the reset arm 100B extends slightly into the area occupied by the lighter 14B. Thus, when the user moves the lighter upward as shown in FIG. 13E to a position of use, the lighter case will engage the re-set arm 100B pivoting the outer end upwardly and the inner end downwardly as shown. This pivotal motion serves as a passive and automatic re-set mechanism imparting downward movement to the small tumbler 230 and, in turn, moving the large tumbler 70B downwardly returning the large tumbler to a position shown in FIG. 13E between the channel wall and rocker arm projection. When the user manually moves the lighter downwardly returning it to a position received within the sleeve, the locking pin 62B will again align with a portion of the lighter to retain it in the locked position.

Figure 15:
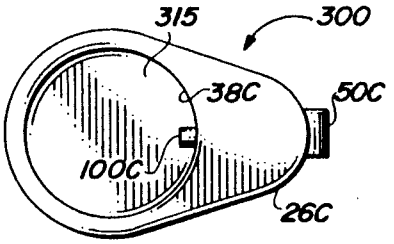
FIG. 15 is a top view of the device of FIG. 14.
Figure 14:
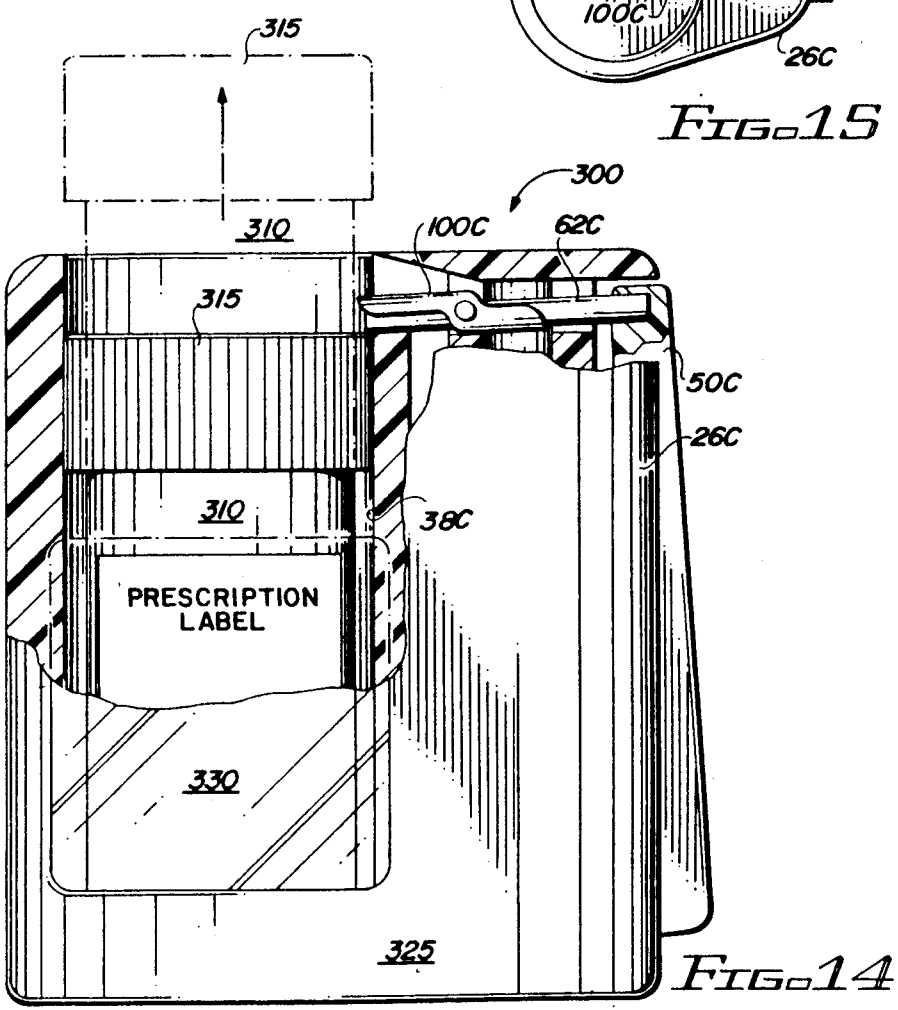
FIG. 14 is a side view, partly broken away, showing the locking device applied to a medication container.

Referring to FIGS. 14 and 15, still another embodiment of the present invention is shown generally designated by the numeral 300 with elements common to previous embodiments indicated by the same numerals with an appended letter "C". The construction of embodiment 300 is as has been described with reference to previous embodiments particularly FIGS. 8 to 10. The safety device includes a sleeve or housing 26C having a longitudinally extending opening 38C for reception of an item or article to be contained. The safety locking device is operative by means of a locking pin 62C which engages part of the contained item to prevent it from being displaced from the sleeve. The locking pin may be withdrawn only when the safety device is placed in a position, such as an inverted position, allowing the rocker 50C to be depressed moving the locking pin to an unlocked position. Again, the device may be provided with a re-set device 100C which assists in returning the locking components to a locked condition.

In the embodiment shown in FIGS. 14 and 15, the contained device 310 is shown as a container for medication and drugs. The locking pin 62C is disposed to engage the upper surface of the cap 315 of the container. The opening 38C extends through the entire safety device but inwardly projecting stops 325 engage the underside of the container so that it cannot be moved downwardly beyond the position shown in FIG. 14. Preferably, the side wall of the safety device is provided with a window 330 so that the label of the prescription container may be easily read by the user. Since common prescription containers come in several standard sizes, the device as shown would also be provided in several sizes to accommodate the standard sizes of containers and provided to individuals and pharmacies.

Another advantage is that since prescription containers are often small, the added physical size imparted by the safety device would make the handling of the medication more convenient.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A protective device for an article, said device comprising:

(a) a body defining a sleeve having an opening slidably receiving the article with the article being slidable relative to the sleeve from a first protected position within the sleeve in which the article is not readily accessible and a second position in which the article is at least partially extended from the body and the article is in an accessible position for use;

(b) said body defining a channel adjacent the said sleeve opening;

(c) rocker means carrying a locking member, said locking member moveable between a first locked position engaging a portion of said article and a second unlocked position out of engagement with said article; and (d) tumbler means moveable in said channel normally positioned to obstruct movement of said rocker means to maintain said locking means in said locked position, said tumbler means being responsive to gravity when the body and article are moved to a predetermined position to move said tumbler to a second position permitting said rocker means to be moved to a position placing said locking member in an unlocked position so the article can be slidably moved from said second position to said extended position of use.

2. The protective device of claim 1 further including biasing means associated with said rocker means normally urging said rocker means to said locked position.

3. The protective device of claim 1 wherein said tumbler means comprises a spherical ball moveable in said channel

4. The protective device of claim 1 wherein said rocker means comprises an elongate arm pivotally mounted in said body and having a thumb lever accessible through an opening in said body.

5. The protective device of claim 1 further including re-set arm means pivotally carried on said locking pin means having an end engageable by the article and an opposite end disposed in said channel whereby extension of the article will impart movement to the re-set arm means causing a force to be applied to said tumbler means to urge said tumbler means to said normally locked position.

6. The protective device of claim 1 wherein said housing is fabricated from plastic.

7. The protective device of claim 1 wherein said opening is configured to receive a medication container.

8. The device of claim 1 wherein said tumbler means includes a first larger spherical ball and a second smaller spherical ball, receptacle means for receiving said smaller spherical ball when said device is moved to said predetermined position, and detent means associated with said rocker means engageable with said smaller spherical ball when the said ball is in said receptacle to retain said rocker means in said second unlocked position.

9. The device of claim 8 further including re-set arm means pivotally carried on said locking pin means having an end engageable by the said article and an opposite end engageable with said smaller spherical ball when the same is positioned on said receptacle in said predetermined position whereby extension of said article will apply a force to the smaller spherical ball to re-set the device urging the balls to said normally locked position.

10. The device of claim 9 wherein said sleeve opening is configured to accommodate a disposable lighter.

11. The device of claim 9 wherein said sleeve opening is configured to accommodate a medicine container.

12. The device of claim 9 wherein at least a portion of said sleeve defines an area permitting visual inspection of the contained article.

13. A protective device for restricting access to a disposable lighter having a housing, actuator and fuel lever, said device comprising:

(a) a body defining an opening receiving the lighter with the lighter being slidable relative to the body from a first protected position within the body in which the lighter is not readily accessible and a second position in which the article is at least partially extended from the body and is in an accessible position for use;

(b) said body defining a channel adjacent the said opening;

(c) rocker means carrying a locking member, said locking member moveable between a first locked position engaging a portion of said lighter and a second unlocked position out of engagement with said lighter; and (d) tumbler means moveable in said channel normally positioned to obstruct movement of said rocker means to maintain said locking means in said locked position, said tumbler means being responsive to gravity when the body sleeve and lighter are moved to a predetermined inverted position to move said tumbler to a second position permitting said rocker means to be moved to a position placing said locking member in an unlocked position so the lighter can be slidably moved from said second position to said extended position of use permitting actuation of said fuel lever.

14. The protective safety device of claim 13 further including biasing means associated with said rocker means normally urging said rocker means to said locked position.

15. The protective safety device of claim 13 wherein said tumbler means comprises a spherical ball moveable in said channel.

16. The protective safety device of claim 13 wherein said rocker means comprises an elongate arm pivotally mounted in said sleeve and having a thumb lever accessible through an opening in said body.

17. The protective safety device of claim 13 further including arm means pivotally carried on said locking pin means having an end engageable by the article and an opposite end disposed in said channel whereby extension of the article will pivot the arm means causing a force to be applied to said tumbler means to urge said tumbler means to said normally locked position.

18. The protective safety device of claim 13 wherein said housing is fabricated from plastic.

19. The protective safety device of claim 13 wherein said body has a shield which obstructs said actuator in said first lighter position.

* * * * *